US006020690A

United States Patent [19]

Takeda et al.

[11] Patent Number: 6,020,690

[45] Date of Patent: Feb. 1, 2000

[54] ELECTRODELESS DISCHARGE LAMP AND THE MANUFACTURING METHOD THEREOF

[75] Inventors: Mamoru Takeda, Soraku-gun; Tomizo Matsuoka, Neyagawa; Akira Hochi, Nara, all of Japan

[73] Assignee: Matsushita Electric Industrial Co., Ltd., Osaka, Japan

[21] Appl. No.: 08/787,987

[22] Filed: Jan. 23, 1997

[30] Foreign Application Priority Data

Jan. 24, 1996 [JP] Japan ..... 8-009763

[51] Int. Cl.[7] ..... H05B 41/16

[52] U.S. Cl. ..... 315/248; 315/344; 313/493; 313/624; 313/231.41

[58] Field of Search ..... 315/248, 39, 344; 313/493, 624, 231.41, 231.71, 563, 576

[56] References Cited

U.S. PATENT DOCUMENTS

| | | | |
|---|---|---|---|
| 4,586,115 | 4/1986 | Zimmerman et al. | 362/217 |
| 4,623,822 | 11/1986 | Provencher | 315/34 |
| 5,065,075 | 11/1991 | Greb | 315/248 X |
| 5,070,277 | 12/1991 | Lapatovich | 315/245 |
| 5,113,121 | 5/1992 | Lapatovich et al. | 315/248 |
| 5,150,015 | 9/1992 | Heindl et al. | 315/248 |
| 5,187,412 | 2/1993 | El-Hamamsy et al. | 315/248 |
| 5,592,048 | 1/1997 | Wei et al. | 313/570 |
| 5,637,963 | 6/1997 | Inoue et al. | 315/248 |

FOREIGN PATENT DOCUMENTS

| | | |
|---|---|---|
| 54-119783 | 9/1979 | Japan . |
| 57-088643 | 6/1982 | Japan . |
| 58-014447 | 1/1983 | Japan . |
| 01236544 | 9/1989 | Japan . |
| 04036929 | 2/1992 | Japan . |

OTHER PUBLICATIONS

B.P. Turner et al., "Progress in Sulfur Lamp Technology", *7th International Symposium on the Science & Technology of Light Sources,* pp. 125–126 (1995).

*Primary Examiner*—Haissa Philogene
*Attorney, Agent, or Firm*—Ratner & Prestia

[57] ABSTRACT

An electrodeless discharge lamp has an arc tube which seals at least rare gas and one of luminous metal and metal halide thereinto, an opening of the arc tube being vacuum-sealed with at least molten glass, and an sealing unit of the arc tube being placed outside a cavity which supplies excitation energy to make said electrodeless discharge lamp emit a light.

18 Claims, 11 Drawing Sheets

ELECTRODELESS DISCHARGE LAMP AND THE MANUFACTURING METHOD THEREOF

BACKGROUND OF THE INVENTION

1. Field of the Invention

The present invention relates to an electrodeless discharge lamp and the manufacturing method of the lamp, and more particularly to a ceramic arc tube which contains metal halide with high vapor pressure, and a method for sealing the tube with a ceramic plate and molten glass.

2. Related Art of the Invention

As an electrodeless discharge lamp which inputs microwave to produce luminescent energy, a lamp with a quartz arc tube sealing sulfur and rare gas therein has become commercially practical (refer to the 7th International Symposium on the Science & Technology of Light Sources: B. P. Turner et al 1995, p.125). Furthermore, electrodeless ceramic discharge lamps in which an alkaline metal and inert gas are sealed with either monocrystalline alumina or polycrystalline alumina are being developed, as disclosed in Japanese Laid-Open Patent Application No. 54-119783.

However, the conventional microwave exciting high-pressure electrodeless discharge lamp with a quartz arc tube is poor in heat conductivity, so that the provision of a motor-driven support bar is necessary to heat uniformly the tube as shown in FIGS. 7*a* and 7*b*. An electrodeless lamps has a long life because of the absence of blacking which results from the evaporation of electrode materials. However, the life of the lamp depends on the durability of the motor which is needed to heat uniformly the tube.

On the other hand, since an alkaline metal in the electrodeless discharge tube which is sealed with either monocrystalline alumina or polycrystalline alumina is not in a halogenated state, it is believed that a tremendous power must be supplied to evaporate the alkaline metal and obtain an effective emission spectrum For this reason, an electrodeless discharge lamp with a ceramic arc tube sealing halide having high vapor pressure as luminescent material is not yet in the actual use.

In a sodium lamp which is the only ceramic discharge lamp that has become commercially practical, a cermet which is placed in the electrode sealing unit is induction-heated to melt the molten glass for the sealing. However, the induction-heating cannot be applied to the microwave electrodeless discharge lamp because of the absence of electrodes. A high-pressure sodium lamp which uses aniobium fine tube as the sealing unit has been in practical use. However, if the arc tube contains a metal inside the cavity which supplies energy, the metallic part in the cermet or niobium is locally heated, and as a result, the arc tube is easily destroyed.

SUMMARY OF THE INVENTION

In order to achieve a microwave electrodeless discharge lamp which can input high energy without using any rotation mechanism, ceramic material with heat-resistance higher than vitreous silica may be used. In order to realize an electrodeless discharge lamp with ceramic material, a ceramic tube may be inserted into a heat-resistant tube, and a heat absorber may be used to heat the sealing unit with its heat, instead of directly heating the unit in induction-heating.

In view of these points, the present invention provides the following elect rodeless discharge lamp.

That is, an electrodeless discharge lamp of the present invention comprises an arc tube which seals at least rare gas and one of luminous metal and metal halide thereinto, an opening of said arc tube being vacuum-sealed with at least molten glass, and an sealing unit of said arc tube being placed outside a cavity which supplies excitation energy to make said electrodeless discharge lamp emit a light.

The manufacturing method of an electrodeless discharge lamp of the present invention comprises the steps of:

inserting a ceramic arc tube into a heat-resistant tube, said ceramic arc tube having an end which is previously closed airtight and sealing at least one of metal halide and luminescent metal thereinto; and heating a sealing portion of said ceramic arc tube up to a temperature higher than other portions thereof in order to vacuum-seal the other end of said ceramic arc tube with a lid member and molten glass.

<Reference Numbers>

1. ceramic arc tube

Figure 1A:
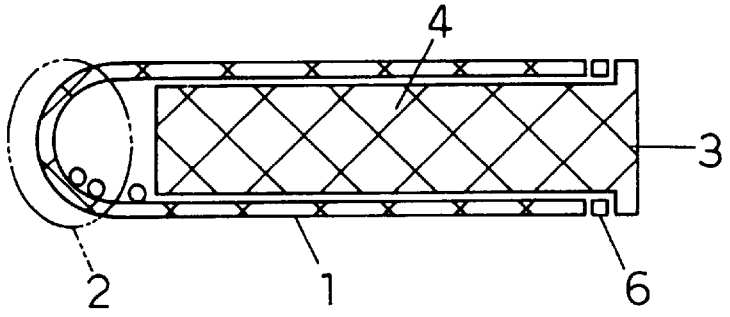
FIG. 1*a* is a sectional view of the ceramic electrodeless discharge lamp of an embodiment of the present invention, and further shows the arc tube whose one end is previously sintered.

2. sealed end of the ceramic are tube

3 ceramic sealing lid

4 ceramic sealing stick portion

5 ceramic sealing member

6 melt glass for sealing (ring)

7 luminescent material

8 vacuum container for sealing

9 heating unit of a local heating device

10 cooling unit of the local heating device

11 microwave guide

12 microwave cavity

13 arc tube support

14 arc tube rotation motor

15 cermet

16 spacer for preventing the adhesion of the molten glass to the vacuum container during the vacuum-sealing

17 vacuum system flange

18 flange for connection

19 O-ring for sealing

20 pressing ring

21 sealing unit

22 arc tube support

23 quartz bulb (arc tube)

24 ceramic for protecting cermet

25 microwave heat absorber

26 positioning motor

27 collar for supporting the arc tube 1

28 through hole

29 discharge electrode

DETAILED DESCRIPTION OF PREFERRED EMBODIMENTS

The preferred embodiments of the present invention will be detailed with reference to the drawings.

As shown in FIG. 1*a,* one end 2 of a ceramic tube 1 has been previously sealed by sintering. From the other end of the ceramic tube 1, a bolt-shaped ceramic ember 5 is inserted thereinto. The ceramic member 5 consists of a disk-shape end 3 and a stick portion 4. The disk-shape end 3 and the stick portion 4 have respectively a larger diameter and a smaller diameter than the inside diameter of the ceramic tube 1 which functions as an arc tube. These lengths of the stick portion 4 and the tube 1 determines the arc length. To be more specific, the arc length is obtained by subtracting the length of the stick portion 4 from the entire length of the tube 1. A molten glass ring 6 with a diameter larger than the inside diameter of the tube 1 is attached to the ceramic member 5 to seal the tube 1.

The aforementioned construction allows the arc size to be changed freely by changing either the length of the stick portion 4 of the ceramic member 5 or the inside diameter of the tube 1 and the diameter of the stick portion 4. This is because when the electrodeless discharge lamp with microwave is discharged, the arc discharge approaches the tube wall and spreads to the entire tube, making the tube 1 and the arc approximately equal in size.

To achieve a discharge lamp for projection requires a short arc, which demands the size reduction of the tube 1. However, when a quartz tube is used as the tube 1, a cooling system is required because of its poor heat resistance. For this reasons in the conventional method, a motor-driven support bar is provided to the tube 1 for cooling. In contrast, when the tube is made of ceramic material as in the present invention, a better uniform heating property is obtained from the same power, compared with a tube which is made of quartz. Also, sufficient luminous property is obtained without using a rotation mechanism.

Figure 1B:
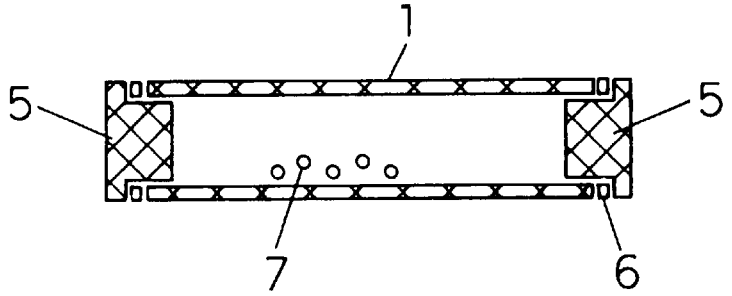
FIG. 1*b* is a sectional view of the ceramic electrodeless discharge lamp of another embodiment of the present invention.

In the present embodiment, only the end 2 of the ceramic arc tube 1 is sealed when the ceramic is sintered. However, the other end may also be sealed with the ceramic member 5 as shown in FIG. 1*b*.

Figure 1C:
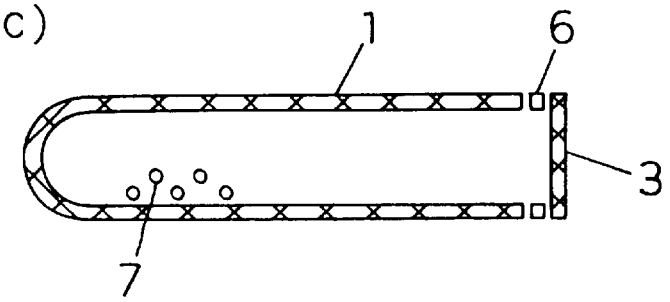
FIG. 1*c* is a sectional view of the ceramic electrodeless discharge lamp of another embodiment of the present invention.

Although the ceramic member 5 is convex in the aforementioned explanation, a ceramic plate 3 shown in FIG. 1*c* may be used instead. However, one end of the tube 1 must be sealed prior to the sealing of luminescent material and rare gas.

The ceramic arc tube 1 of the present invention is made of translucent ceramics with high melting points such as high purity alumina, YAG (yttrium aluminum garnet), yttria, and aluminum nitride Since these materials can be processed at higher temperatures than quartz, water removal is executed more sufficiently. Consequently, the reaction with the luminescent material 7 and the tube is restrained, and as a result, devitrification is reduced.

The manufacturing method of the electrodeless discharge lamp of the present invention with the use of a ceramic tube will be described as follows with reference to FIGS. 2–5.

Figure 2:
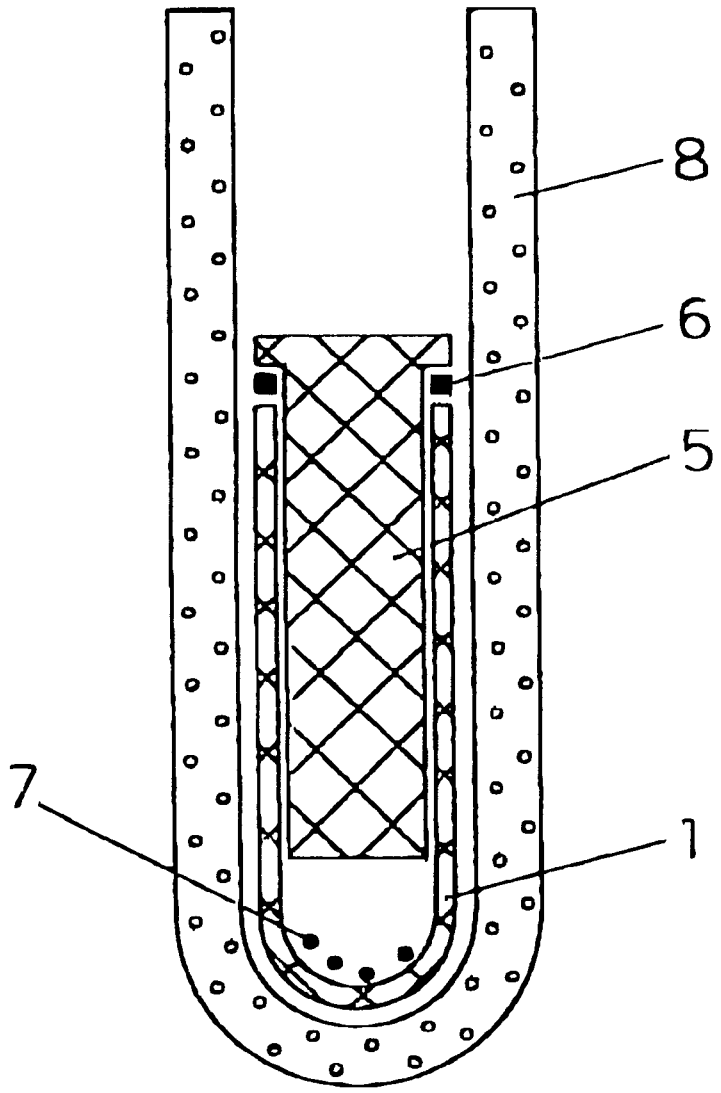
FIG. 2 is a sectional view depicting a step of the manufacturing method of the electrodeless discharge lamp of an embodiment of the present invention.

As shown in FIG. 2, the ceramic arc tube 1 which contains luminescent material 7 is sealed with a molten glass 6 and the bolt-shaped ceramic member 5, and then put into a vacuum glass container 8. The container 8 corresponds to the heat-resistant tube of the present invention.

Figure 3:
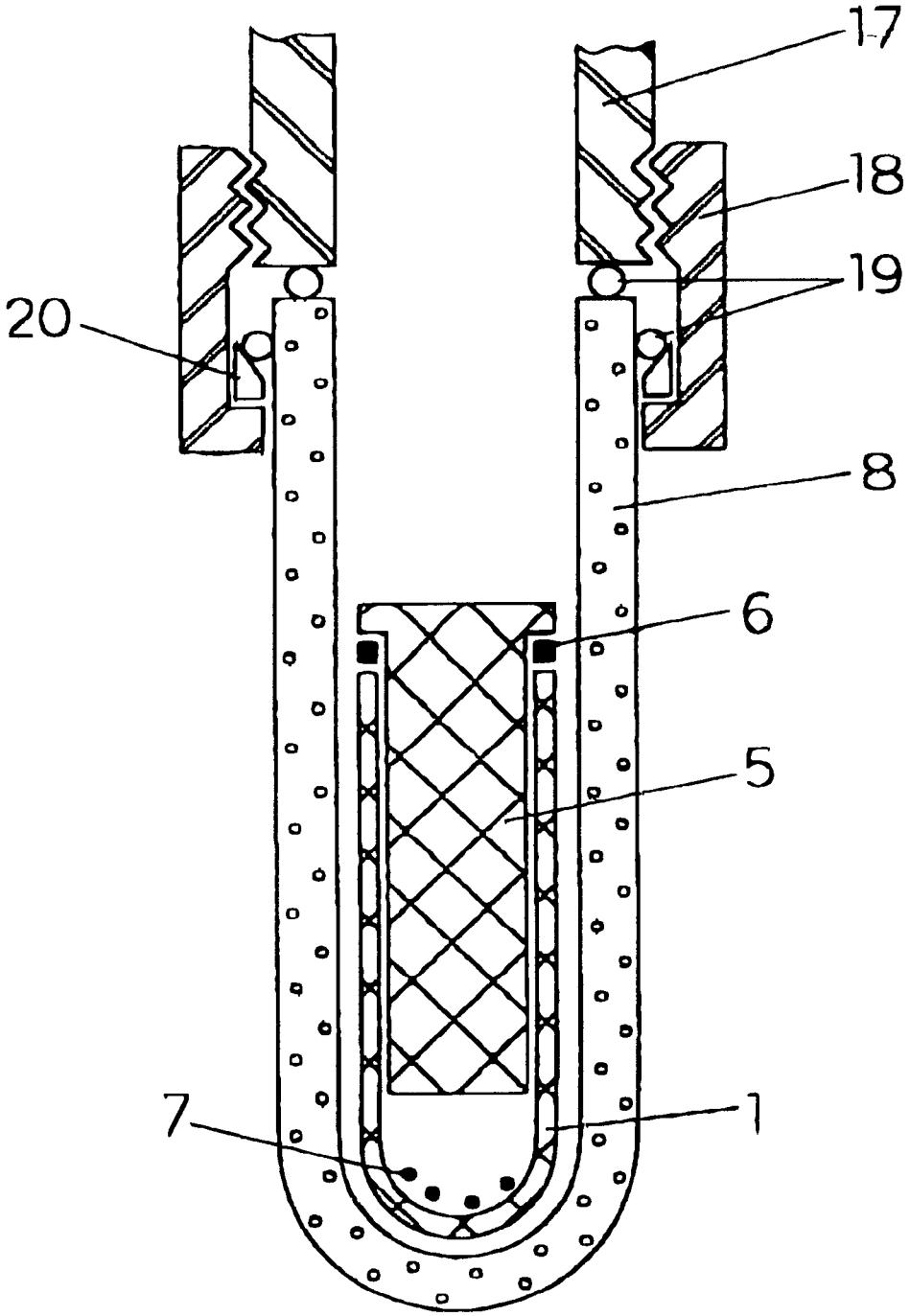
FIG. 3 is a sectional view depicting another step of the manufacturing method of the electrodeless discharge lamp of the embodiment of the present invention.

Then, as shown in FIG. 3, the container 8 is connected to a vacuum system in order to be evacuated. To be more specific, the container 8 is sealed with a flange 17 of the vacuum system, a flange 18 for connection, and an O-ring 19. When the flange 18 for connection is tightened, the O-ring 19 is pressed by a pressing ring 20, and as a result, airtight connection is completed. Then, the air in the container 8 is exhausted until a certain background, and inert gas such as argon is sealed thereinto ta the certain pressure.

Figure 4:
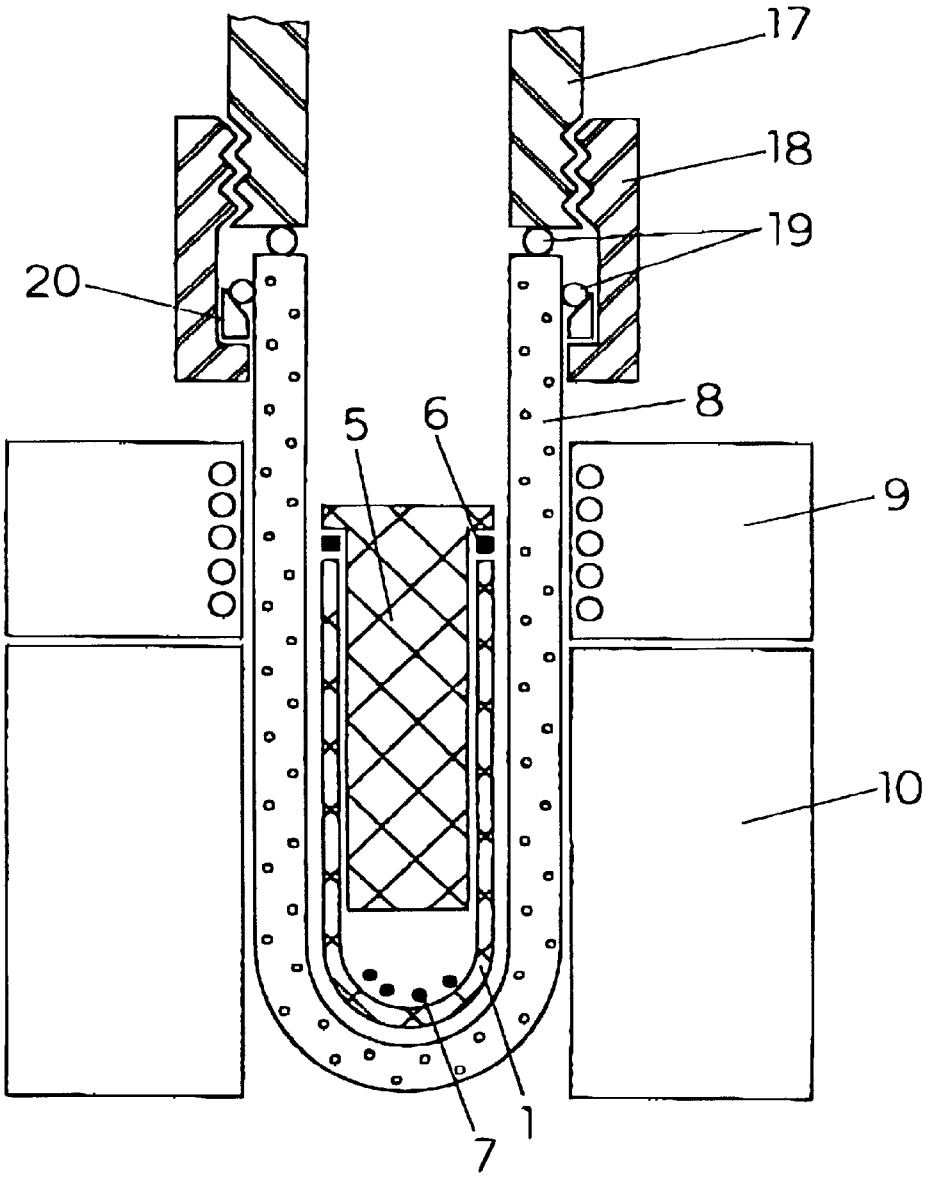
FIG. 4 is a sectional view depicting further another step of the manufacturing method of the electrodeless discharge lamp of the embodiment of the present invention.

As shown in FIG. 4, a heater 9 for local heating is provided near a sealing unit to melt the molten glass 6 with its heat, thereby connecting the tube 1 and the ceramic member 5. At this moment, the lower portion of the tube 1 where the ceramic luminescent material 7 stays is cooled with either water or air by a cooler 10. This cooling operation prevents the ceramic luminescent material 7 from evaporating from the arc tube material.

Furthermore, the joint of the flanges 17 and 18 may be preferably cooled with air or water to prevent the O-ring 19 from being deteriorated with heat.

In the air-exhausting and the arc-tube-sealing methods of the present invention, the container 8 functions as buffer between the cooler 10 and the tube 1 to mitigate the heat shock of the tube 1. Consequently, the tube 1 is prevented from being damaged during the sealing operation with heat, and can be sealed without evaporating the metal halide.

It has been confirmed that the tube 1 can be sealed without evaporating the luminescent material 7 if it is heated up to 1450° C. by means of a local heating of about 2–3 mm with a heater 9 which is made of Kanthal(trade mark) (molybdenum silicide heater) The container 8 and the tube 1 which were used in the experiment are respectively made of vitreous silica, and either alumina or YAG.

Figure 5:
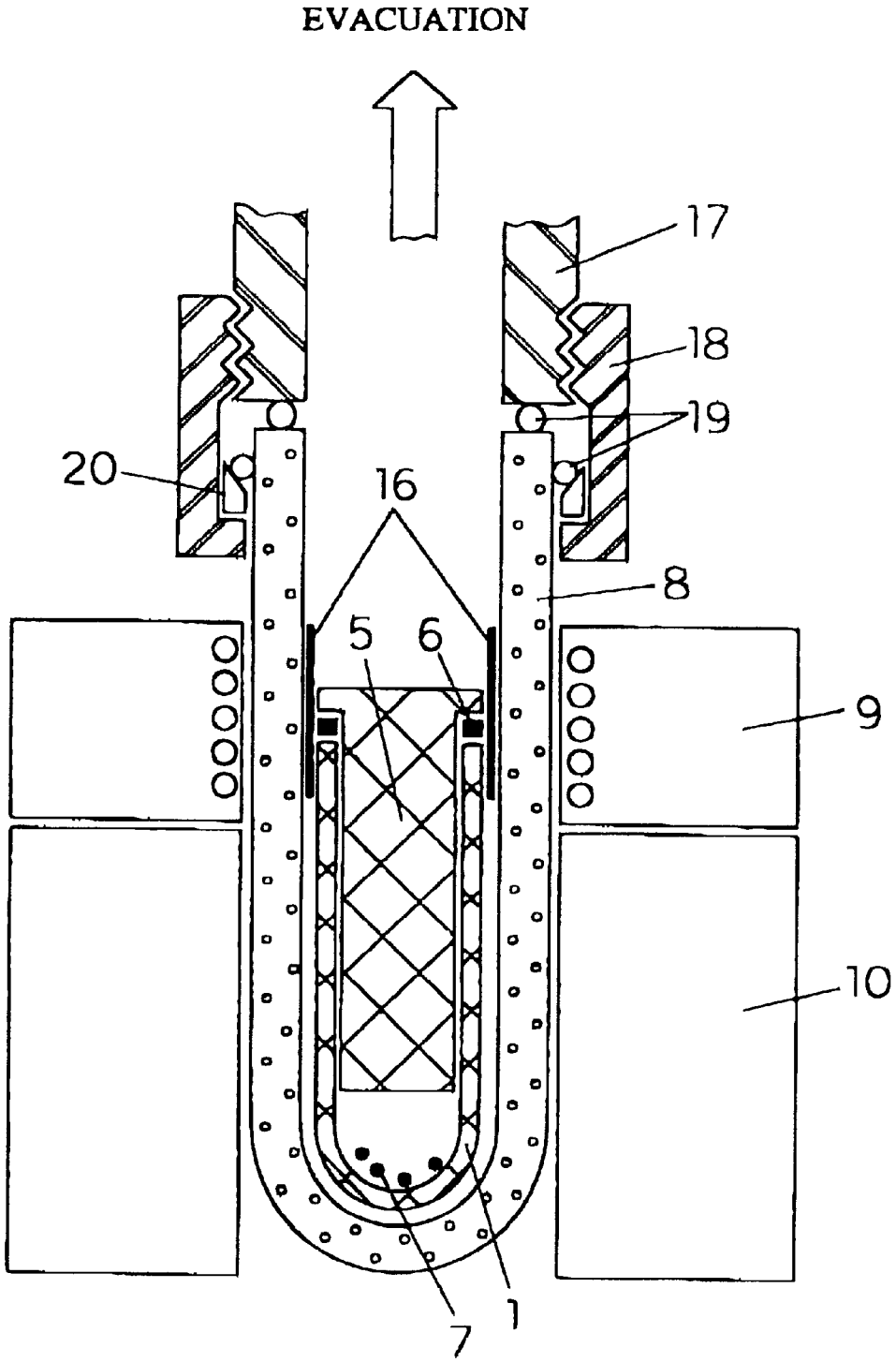
FIG. 5 is a sectional view depicting further another step of the manufacturing method of the electrodeless discharge lamp of the embodiment of the present invention.

If the molten glass 6 is melted with heat and gets in contact with the vitreous silica container 8, the difference of the expansion coefficient during the cooling operation may cause the vitreous silica to break or make it impossible to take the tube 1 out. To avoid this, prior to the sealing operation, the molten glass 6 is covered with a tube 16 which is made of either zirconia or boron nitride as shown in FIG. 5. Consequently, the direct contact between the molten glass 6 and the vitreous silica container 8 is prevented, and there is no trouble in taking the tube 1 out.

Figure 6A:
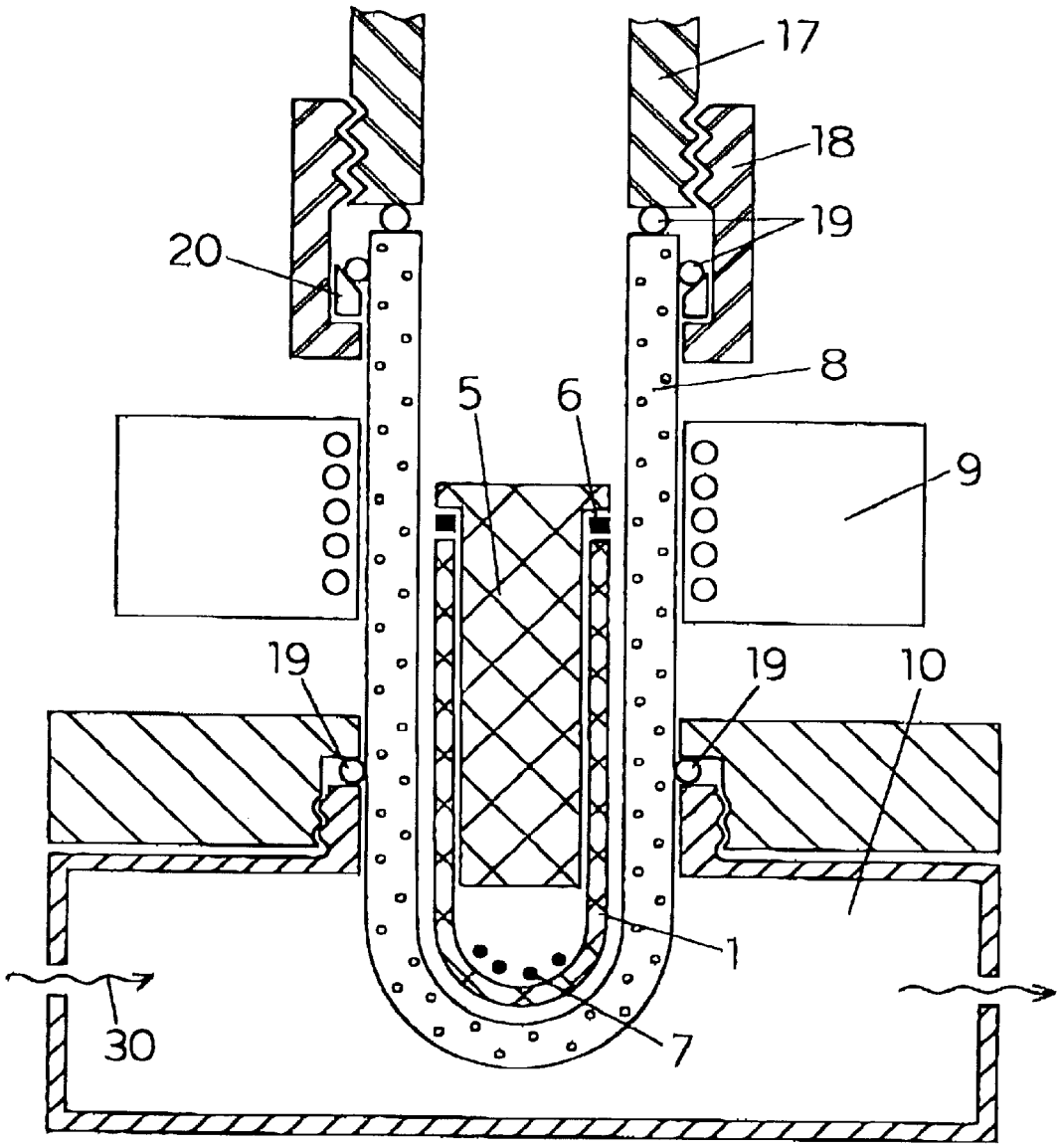
FIG. 6*a* is a sectional view depicting further another step of the manufacturing method of the electrodeless discharge lamp of the embodiment of the present invention.
Figure 6:
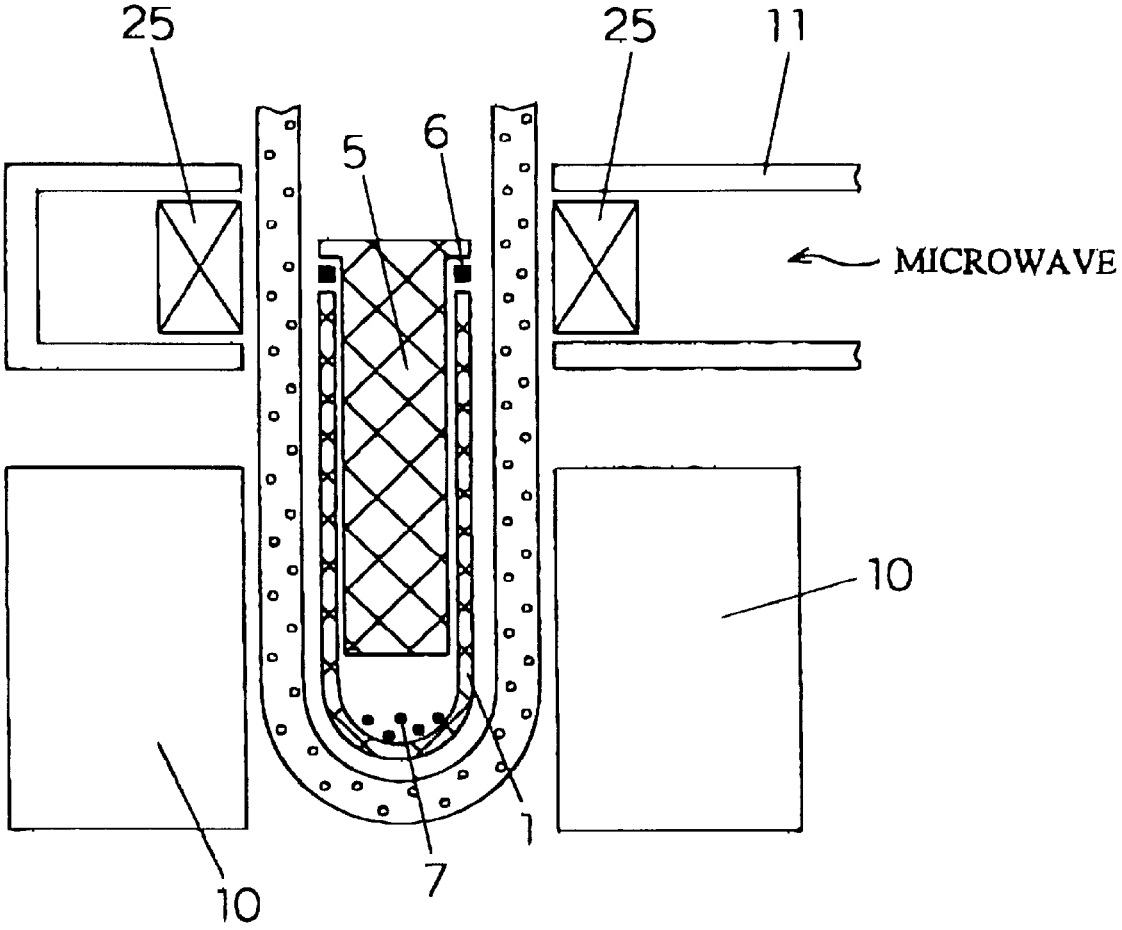
FIG. 6*b* is a sectional view depicting a step of the manufacturing method of the electrodeless discharge lamp of another embodiment of the present invention.

As shown in FIG. 6*a,* it is possible to heat the molten glass 6 locally with the heater 9 and to cool the luminescent material 7 as it is in the container 8. A cooling medium 30 can be water or the like. As shown in FIG. 6*b,* if a microwave heat absorber 25 is provided outside the container 8 to input microwave, the molten glass 6 can be exclusively melted to seal the tube 1 only by controlling the power.

This method allows the tube 1 to be heated more locally than ordinary heaters, so that the sealing operation can be performed more firmly without causing the luminescent material 7 inside the tube 1 to evaporate.

Different devices which allow the electrodeless ceramic arc tube thus manufactured to emit a light through microwave excitation will be described as follows with reference to FIGS. 7–11.

Figure 7A:
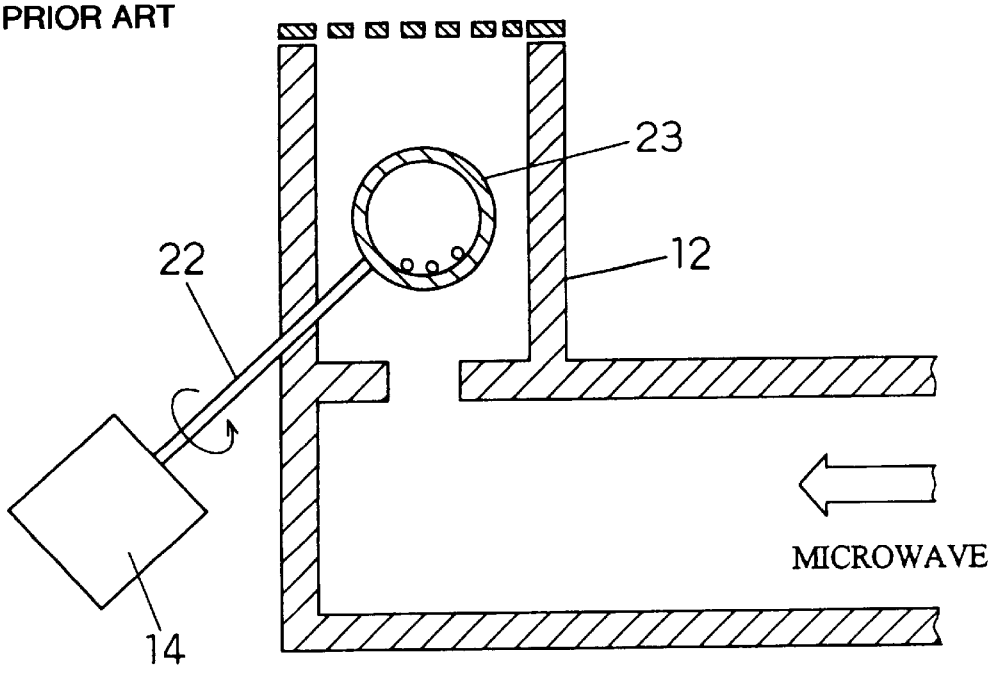
Fig. 7(a) PRIOR ART
FIG. 7*a* is a sectional view of a conventional microwave exciting quartz valve electrodeless lamp.
Figure 7B:
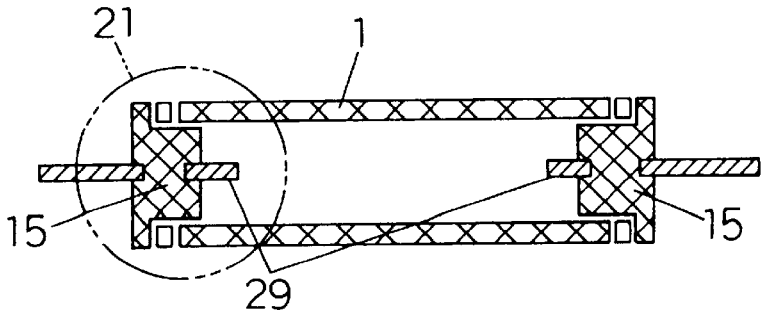
Fig. 7(b) PRIOR ART
FIG. 7*b* is a sectional view of a conventional electrode ceramic lamp.

In a conventional method, as shown in FIG. 7*a,* the vitreous silica arc tube 23 is entirely put inside the microwave cavity 12 and is welded with the support bar 22 which is rotated by an external motor 14. In the case of a ceramic lamp with electrodes 29, the sealing unit 21 cannot help being placed in the vicinity of the arc as shown in FIG. 7*b.*

Figure 8:
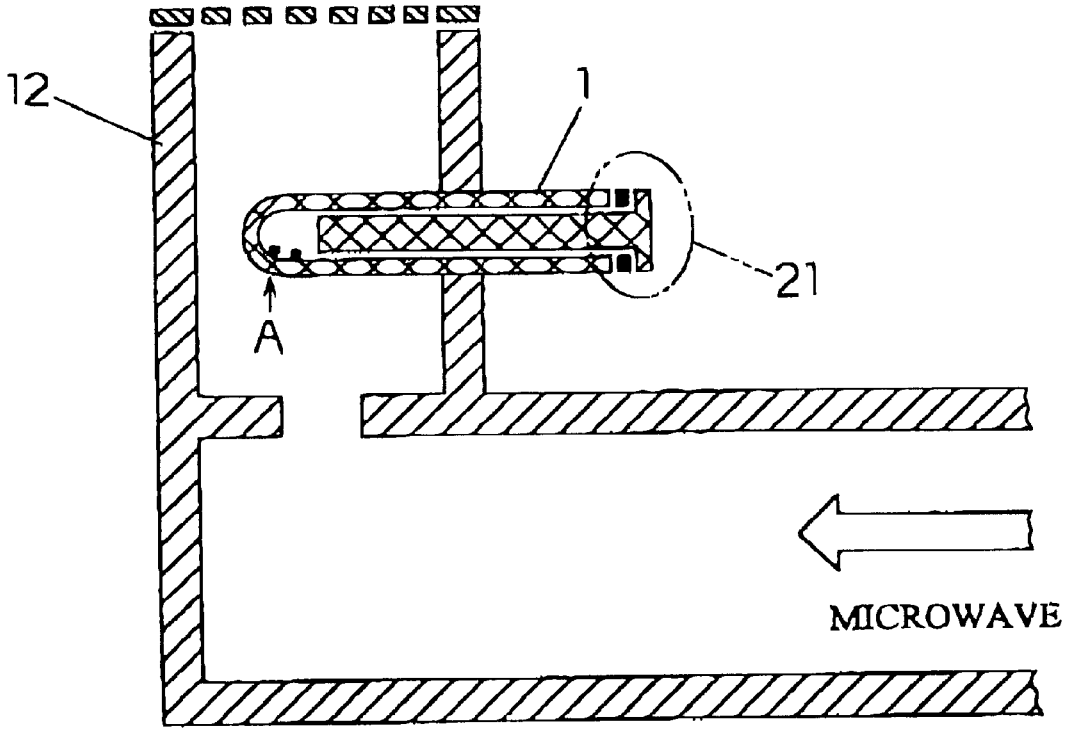
FIG. 8 is a sectional view of a microwave exciting electrodeless lamp which employs the electrodeless lamp of an embodiment of the present invention.
Figure 9:
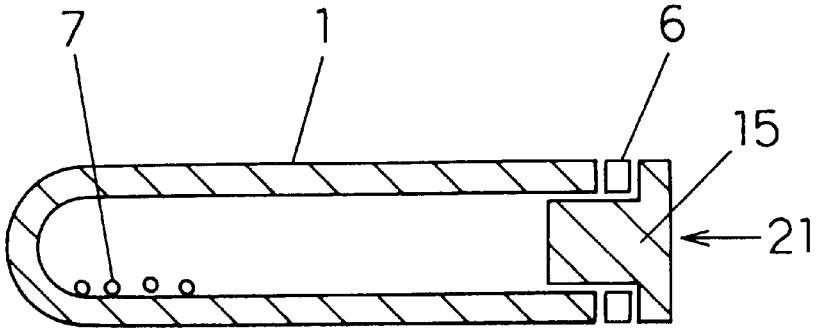
Fig. 9 PRIOR ART
FIG. 9 is a sectional view of a conventional ceramic lamp in which the cermet and the ceramic tube are sealed with molten glass.

In contrast, in the present invention, the sealing unit 21 of the ceramic arc tube 1 is placed outside the microwave cavity 12 and only the luminescence unit A is inside the cavity 12 as shown in FIG. 8. Consequently, the temperature rise of the molten glass 6 is restrained, which makes it possible to determine the amount of energy only by considering the heat resistance of the tube 1. In addition, the temperature rise of the sealing unit 21 in the vicinity of the molten glass 6 is restrained, so that the reaction between the luminescent material 7 and the molten glass 6 is also restrained. As a result, the short life property due to the leak in the sealing unit 21 is improved Therefore, if such a construction for microwave input is used, it is possible to seal the tube 1 with the sealing unit 21 consisting of the conventional cermet 15 and the molten glass 6 as shown in FIG. 9.

Figure 10:
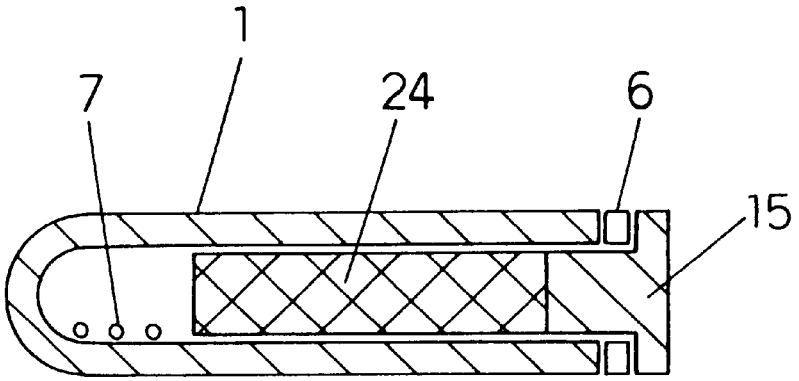
FIG. 10 is a sectional view of a conventional ceramic lamp in which the cermet which is covered with ceramics and the ceramic tube are sealed with molten glass.

When the ceramic stick 24 is provided to protect the cermet 15 from the arc as shown in FIG. 10, the reaction between the luminescent material 7 and the cermet 15 can be restrained.

Figure 11:
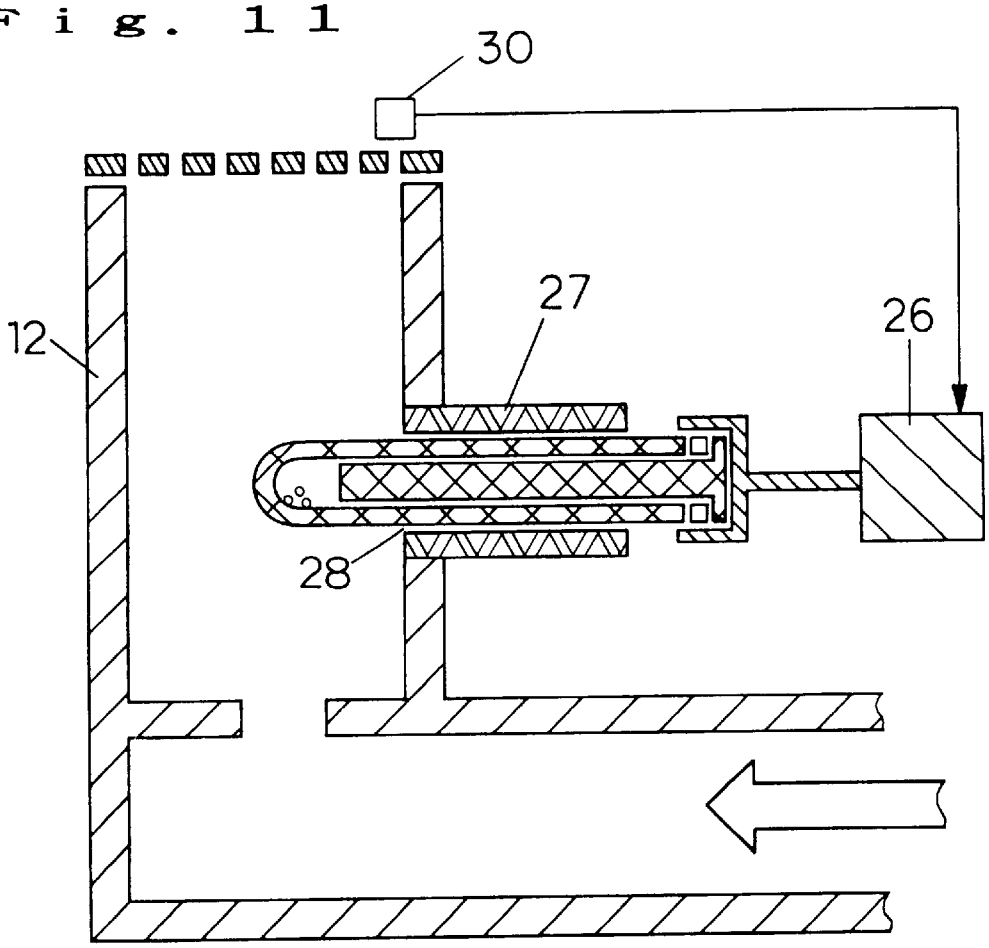
FIG. 11 is a sectional view of the ceramic lamp with a positioning motor which makes the arc tube movable of another embodiment of the present invention.

The construction shown in FIG. 11 allows the tube 1 to be positioned easily. Such easy positioning makes it possible to control the matching of the energy input to the tube 1, and as a result, the luminous intensity can be optimized. Furthermore, if the electric signals corresponding to the luminescence or the luminous intensity is monitored with a sensor 30, the optimum position which produces the maximum intensity can be checked. Therefore, linking the positioning motor 26 with the monitor device 30 makes the positioning easy. To realize this, the tube 1 is fixed with a flange 27 which is provided to the microwave cavity 12, and the diameter of the through hole 28 of the flange 27 is adjusted not to leak the input microwave. Although it is impossible to seal it completely, the leakage can be restricted to 1% or below. The optimum position of the tube 1 varies as the condition of the lamp changes in the life. However, the construction shown in FIG. 11 can cope with the change of the position, depending on the input condition of energy.

Although energy is inputted in the form of microwave in the aforementioned explanation, the present invention is applicable to energy which is inputted in the form of magnetic field or electric field.

The present invention has simplified the manufacturing process of an electrodeless discharge lamp with ceramic material. The use of ceramic material instead of quartz improves the heat-resistance of the lamp and does not have to rely on a cooling mechanism too much. Consequently, the tube itself can be downsized, and suitable as a point source. Furthermore, the manufacturing method of the present invention makes it possible to seal the ceramic without the induction-heating through a conventional cermet.

In addition, since the tube 1 is made of ceramic material such as alumina, the reaction with luminescent material can be more reduced than a vitreous silica tube. As a result, a long-lived lamp is realized.

To place the sealing unit outside the microwave cavity allows cermet or niobium tube to be used for the sealing unit In addition, since the temperature rise of the sealing unit is restrained, the short life property due to leak can be improved.

Furthermore, when the tube is made movable, energy matching can be easily performed even in the initial setting or in the process of lightening.

What is claimed is:

1. An electrodeless discharge lamp having energy input means in a cavity supplying excitation energy comprising:

an arc tube having an opening at a first end, a second opposing end of said arc tube disposed entirely within said cavity, the first end disposed outside of the cavity, said arc tube containing at least rare gas and one of luminous metal and metal halide; and a sealing unit for vacuum-sealing said opening of said arc tube said sealing unit being placed outside said cavity.

2. The electrodeless discharge lamp of claim 1, wherein said arc tube is made of one of ceramic and glass.

3. The electrodeless discharge lamp of claim 1 further comprising a flange to limit leakage of said excitation energy to said outside of said cavity to 1% or below.

4. The electrodeless discharge lamp of claim 1, wherein said arc tube is automatically or manually movable towards said energy input means.

5. The electrodeless discharge lamp of claim 4, wherein luminescent intensity of said arc tube is detected and a position of said arc tube is changed to make the luminescent intensity maximum.

6. The electrodeless discharge lamp of claim 1, wherein said cavity has an opening to insert said arc tube from outside.

7. The electrodeless discharge lamp of claim 1, wherein the opening of said arc tube is vacuum-sealed with a ceramic member and molten glass.

8. The electrodeless discharge lamp of claim 1, wherein the opening of said arc tube is vacuum-sealed with molten glass and one of cermet and a niobium member.

9. The electrodeless discharge lamp of claim 7, wherein said ceramic member is a lid consisting of a stick portion of a first length whose diameter is smaller than an inside diameter of said arc tube, said arc tube having a second length, and a plate portion whose diameter is larger than the inside diameter of said arc tube, and an arc length substantially determined by subtracting said first length from said second length.

10. The electrodeless discharge lamp of claim 7, wherein said ceramic member includes a disk-shaped lid whose diameter is larger than an inside diameter of said arc tube.

11. The electrodeless discharge lamp of claim 8, wherein a part of said cermet which is exposed to the luminescent arc is covered with ceramic material.

12. The electrodeless discharge lamp of claim 2, wherein the opening of said arc tube is vacuum-scaled with a ceramic member and molten glass.

13. The electrodeless discharge lamp of claim 2, wherein said ceramic member is a lid consisting of a stick portion of a first length whose diameter is smaller than an inside diameter of said arc tube, said arc tube having a second length and a plate portion whose diameter is larger than the inside diameter of said arc tube, and an arc length substantially determined by subtracting said first length from said second length.

14. The electrodeless discharge lamp of claim 2, wherein said ceramic member includes a disk-shaped lid whose diameter is larger than an inside diameter of said arc tube.

15. The electrodeless discharge lamp of claim 2, wherein the opening of said arc tube is vacuum-sealed with molten glass and one of cermet and a niobium member.

16. The electrodeless discharge lamp of claim 15, where a part of said cermet which is exposed to the luminescent arc is covered with ceramic material.

17. The electrodeless discharge lamp of claim 1, wherein the energy input means comprises a cavity.

18. An electrodeless discharge lamp providing a luminescent intensity when excited by excitation energy in a cavity, said lamp comprising:

an arc tube having an opening and a portion of said arc tube disposed within said cavity, a sealing unit for vacuum-sealing said opening, said sealing unit disposed outside said cavity, and means for moving said arc tube within said cavity and detecting the luminescent intensity until said luminescent intensity reaches a maximum value.

* * * * *

UNITED STATES PATENT AND TRADE MARK OFFICE

CERTIFICATE OF CORRECTION

PATENT NO. : 6,020,690
DATED : February 1, 2000
INVENTOR(S) : Takeda et al.

It is certified that error appears in the above-identified patent and that said Letters Patent is hereby corrected as shown below:

Column 7, line 7, "2" should read --12--.

Column 7, line 15, "2" should read --12--.

Signed and Sealed this

Tenth Day of April, 2001

*Attest:*

Nicholas P. Godici

NICHOLAS P. GODICI

*Attesting Officer*

*Acting Director of the United States Patent and Trademark Office*